US005596183A

United States Patent [19]

Haley

[11] Patent Number: 5,596,183

[45] Date of Patent: Jan. 21, 1997

[54] SEISMICALLY ACTIVATED APPLIANCE SWITCH

[76] Inventor: Chester M. Haley, 34892 Rancho Vista, Cathedral City, Calif. 92234

[21] Appl. No.: 544,732

[22] Filed: Oct. 18, 1995

[51] Int. Cl.[6] ..... H01H 35/14

[52] U.S. Cl. ..... 200/61.45 R; 200/61.48; 200/61.51; 307/117; 340/690

[58] Field of Search ..... 200/61.45 R, 61.48, 200/61.49, 61.5, 61.51, 61.52, 61.53, 61.45 M; 307/112–125; 340/566, 686, 689, 693, 690

[56] References Cited

U.S. PATENT DOCUMENTS

| | | | |
|---|---|---|---|
| 1,902,578 | 3/1933 | Parsons | 200/61.51 |
| 2,448,597 | 9/1947 | Jolley et al. | 200/61.51 X |
| 3,359,550 | 12/1967 | Christensen | 200/61.51 X |
| 3,783,211 | 1/1974 | Panettieri | 200/61.5 |
| 3,953,084 | 4/1976 | Pittet, Jr. et al. | 200/61.49 X |
| 4,103,697 | 8/1978 | Kiesow | 200/61.53 X |
| 4,297,690 | 10/1981 | Baker | 200/61.49 X |
| 4,353,383 | 10/1982 | Kiesel | 137/45 |
| 4,359,722 | 11/1982 | Valdez et al. | 307/117 X |
| 4,585,358 | 4/1986 | Shay | 368/262 |
| 4,942,386 | 7/1990 | Willis | 200/61.49 X |
| 5,080,362 | 1/1992 | Lillard | 200/61.49 X |
| 5,278,540 | 1/1994 | Caban-Domenech | 200/61.45 R X |
| 5,307,054 | 4/1994 | Concannon, Sr. et al. | 200/61.45 R X |
| 5,307,699 | 5/1994 | Engdahl et al. | 200/61.45 M X |
| 5,418,523 | 5/1995 | Anderson et al. | 200/61.51 X |

*Primary Examiner*—J. R. Scott
*Attorney, Agent, or Firm*—Roy A. Ekstrand

[57] ABSTRACT

A housing supports a seismically responsive switch mechanism having an annular contact ring defining a center aperture within which a contact weight is resiliently supported by a flexible spring rod. A silicon-controlled rectifier is operatively coupled to a DC power input and power output coupling to provide electrical power coupling therebetween when the silicon-controlled rectifier is triggered. The trigger voltage for the silicon-controlled rectifier is provided by a circuit path which includes the annular ring and contact weight. The contact weight defines a frusto-conical outer surface and a ring positioning apparatus supports the ring at different positions with respect to the contact weight to provide different distances between the contact weight and the ring. In one embodiment, the ring positioning apparatus includes a rotatable shaft and a gear coupling which drives a threaded support to raise or lower the contact ring with respect to the contact weight. In an alternate embodiment, the ring is supported by a vertically movable shaft. In a still further alternate embodiment, a pair of seismically responsive switch mechanisms are selectable using a selector switch.

15 Claims, 3 Drawing Sheets

SEISMICALLY ACTIVATED APPLIANCE SWITCH

SPECIFICATION

1. Field of the Invention

This invention relates generally to seismically activated light systems and particularly to seismically activated appliance switches used therein.

2. Background of the Invention

In many areas of the world, seismic activity, such as earthquakes, presents a substantial risk to inhabitants of such areas. While low level seismic activity is virtually continuous over the earth surface, major earthquakes often cause great human injury and property damage. Despite great advances in other sciences, the science of geology has yet to produce an effective method by which geologists can predict the locations and times of occurrences of earthquakes. As a result, the typical earthquake occurs suddenly and unexpectedly and, for the most part, takes the victims by surprise.

The sudden, unexpected and often violent character of earthquakes causes substantial fear among many persons living in so-called earthquake prone areas. In fact, the fear of earthquakes exceeds the actual danger or risk in many instances. Earthquakes occurring at night are particularly frightening. Most people subjected to a nighttime earthquake find themselves jolted from a sound sleep into the terror of a violently shaking dwelling and confusing noises such as items being toppled or broken all around them. Such persons often become panicked or frantic as they stumble about in the dark groping for light switches and/or phones to summon help or get information.

In response to these problems, practitioners in the art have endeavored to provide various seismically responsive safety lights or alarm systems. For example, U.S. Pat. No. 5,307,054 issued to Concannon, Sr., et al. sets forth a motion sensor circuit controller having a ring-shaped first conductor, a second conductor defining a concave conductive surface, a base for supporting the first conductor horizontally oriented above the second conductor with the first and second conductors being connected within a circuit. A conductive ball rollably contacts the second conductor and makes electrical contact between the first and second conductors in response to lateral movement of the conductor. The electrical contact between first and second conductors is used to operate various devices such as a battery-power flashlight or the like. This system is subject to several substantial limitations rendering impractical aspects when considered in a practical manufacturing environment. For example, the unit must be disassembled and other combinations of the ball 16, the inside diameter of ring 18 and the concavity of the screen 42 can be selected for producing the same sensitivity or other desired sensitivities. Further, the triggering of the alarm or light requires that four electrical contacts be completed. The system is extremely demanding on contact actuation and thus high cost gold plated contacts are required.

U.S. Pat. No. 4,359,722 issued to Valdez, et al. sets forth a EARTHQUAKE DETECTION SYSTEM WITH PENDULUM SWITCH having a suspended pendulum which at its lower end has an electric contact space from a stationary ring-shaped contact which surrounds the pendulum contact. During an earth tremor, the stationary contact moves in response to earth motion thereby engaging the suspended pendulum contact and accordingly closing an electric circuit with audible alarm.

U.S. Pat. No. 4,353,383 issued to Kiesel sets forth a SEISMICALLY ACTUATED VALVE RELEASE STRUCTURE for automatically closing or opening a valve upon the occurrence of an earthquake. The release mechanism includes a pendulum which is biased upwardly against stop means formed for pivotal contact with an upper end of the pendulum. The stop means and the upper end have relatively small contact area. Biasing means urge a closure member within the valve toward an open or closed position and the closure member is releasibly retained against the urging of the biasing means by a latch.

U.S. Pat. No. 4,585,358 issued to Shay sets forth a SHAKEABLE SHUT-OFF ALARM CLOCK having a standard alarm configured to be silenced by lateral shaking of the clock. The silencing mechanism includes a laterally shakeable switch responsive to clock motion.

U.S. Pat. No. 5,307,699 issued to Engdahl, et al. sets forth a SEISMIC INITIATOR FOR EARTHQUAKE SHUT-OFF VALVES AND THE LIKE having an acceleration responsive magnet device for closing a valve or operating a switch or the like in response to a disturbance such as an earthquake. A pendulum operates to increase the length of a magnetic path releasing a magnetic element to perform the desired actuation.

U.S. Pat. No. 5,278,540 issued to Caban-Domenech sets forth an ELECTROMECHANICAL EARTHQUAKE ALARM having an earthquake sensor in which a weight falls from a support surface and activates a switch in the event of an earthquake. The support surface is preferably a bell with its open end oriented downward and the weight resting on a concave recessed region at the closed end of the bell.

U.S. Pat. No. 4,103,697 issued to Kiesow sets forth a SAFETY SENSOR DEVICE for automatically shutting off the flow of fluids such as water, gas, oil or steam or for shutting off electric power or actuating an alarm in the event of an earthquake. The device includes a spring-loaded shutoff member normally held in a retracted position by a latch. A pendulum is connected to the latch such that upon the occurrence of an earthquake, movement of the pendulum occurs releasing the latch.

While the foregoing prior art devices have improved the art and, in some instances, enjoyed commercial success, there remains nonetheless a continuing need in the art for evermore effective reliable, simple to operate seismically activated appliance switching apparatus.

SUMMARY OF THE INVENTION

Accordingly, it is a general object of the present invention to provide an improved seismically activated appliance switch. It is a more particular object of the present invention to provide an improved seismically activated appliance switch having a reliable actuation mechanism which is simple to use and which is easily adjusted to a desired seismic activity trigger level. It is a still particular object of the present invention to provide an improved seismically activated appliance switch which utilizes an improved trigger mechanism within a cooperating electrical circuit.

In accordance with the present invention, there is provided for use in controlling an electrically powered device, a seismically activated switch comprising: an electronic switch having a controlled power coupling path and a trigger input; an input power coupler and output power coupler interconnected through the controlled power coupling path; an annular ring defining a ring plane and an aperture; a contact weight defining a varying cross-section; a spring rod having a fixed end and a free end, the free end being secured to the contact weight and the spring rod resiliently supporting the contact weight; and adjustable ring support means for supporting the ring such that the contact weight extends through the aperture of the ring and for raising and lowering the ring to move the ring plane with respect to the contact weight, the trigger input being coupled to the input power coupler through contact of the annular ring and the contact weight.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figures 1, 2, 3, 4, 5:
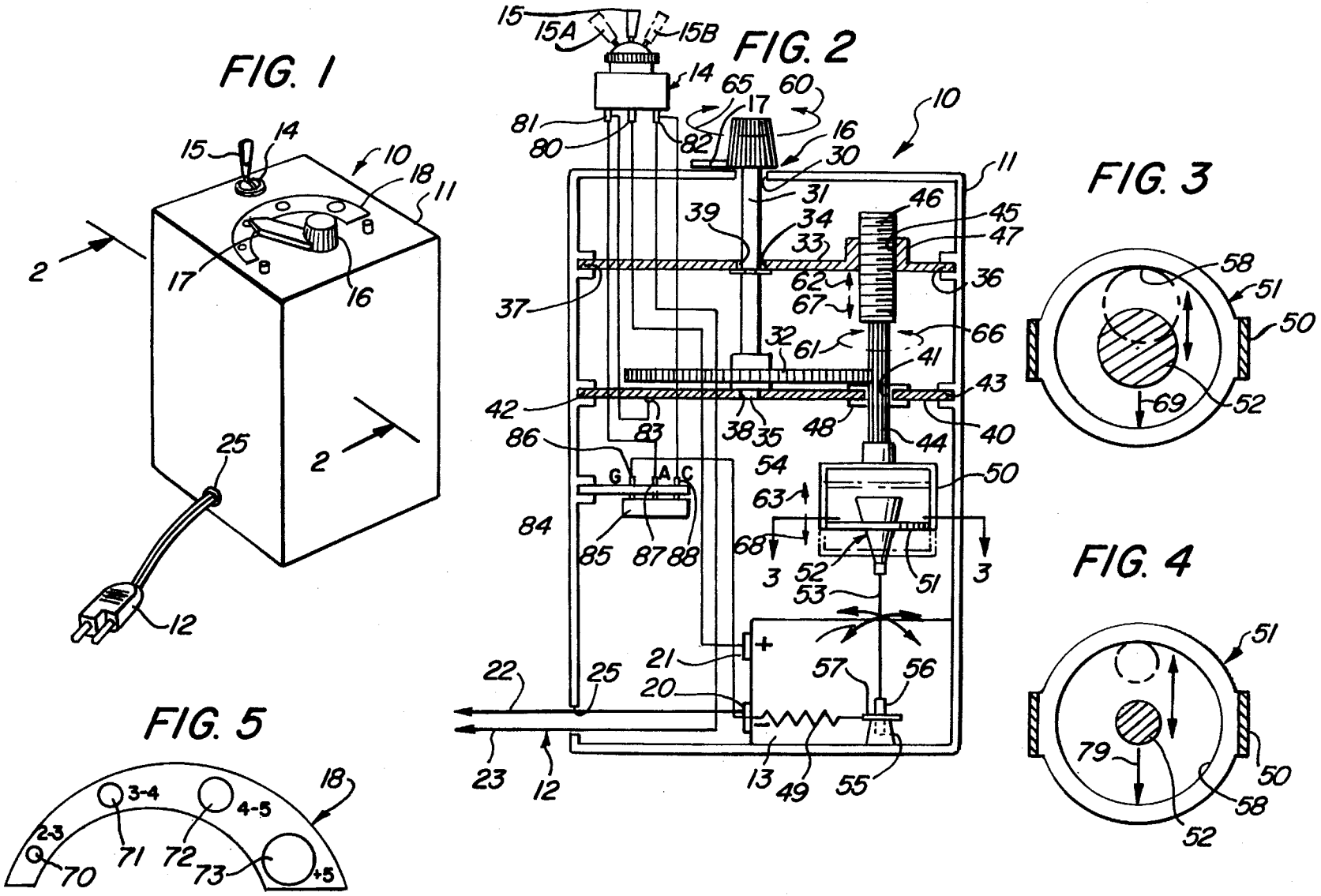
FIG. 1 sets forth a perspective view of a seismically activated appliance switch constructed in accordance with the present invention.
FIG. 2 sets forth a section view of the seismically activated appliance switch of FIG. 1 taken along section line 2—2 therein.
FIG. 3 sets forth a partial section view of the present invention seismically activated appliance switch taken along section line 3—3 in FIG. 2.
FIG. 4 sets forth a partial section view of the present invention seismically activated appliance switch taken along section line 3—3 in FIG. 2 showing an alternative adjustment of the switch sensitivity with respect to the section view of FIG. 3.
FIG. 5 sets forth a top plan view of the seismic scale utilized in the present invention seismically activated appliance switch of FIG. 1.

FIG. 1 sets forth a perspective view of an appliance control unit generally referenced by numeral 10 utilizing a seismically activated appliance switch constructed in accordance with the present invention. Control unit 10 includes a housing 11 having an electrical battery 13 and a controlled power output 12 passing through aperture 25 of housing 11. Housing 11 further supports a rotatable sensitivity adjuster 16 having an extending pointer 17. A sensitivity scale 18 is supported upon the upper surface of housing 11 in association with pointer 17. A switch 14 having a movable toggle 15 is supported upon housing 11. In accordance with the operation set forth below in greater detail, a battery 13 provides an internal electric power source. Correspondingly, power output 12 is coupled to an appliance (not shown) constructed in accordance with conventional fabrication techniques which is to be controlled by control unit 10 in the manner described below. Suffice it to note here that electrical power provided at battery 13 is operatively coupled to output 12 in response to seismic activity causing motion of control unit 10 sufficient to exceed the sensitivity level to which the internal switching mechanism of control unit 10 (seen in FIG. 2) is set. Switch 14 preferably defines three operative positions, one of which is designated an off position in which the system is entirely unresponsive and no power is coupled to output 12 under any circumstances. The second position of switch 14 preferably corresponds to a system activated position in which, by means set forth below in greater detail, electrical power is coupled from battery 13 to output 12 solely upon the occurrence of seismic activity sufficient to trigger the internal seismic switch within control unit 10. Finally, the third operative position of switch 14 provides a simple on function in which electrical power is coupled from battery 13 to output 12 directly without the need for triggering of the seismic switch within control unit 10. This direct coupling eliminates the 0.7 volt drop across the silicon controlled rectifier (SCR 85 seen in FIG. 2). By means set forth below in greater detail, sensitivity adjuster 16 is pivoted moving pointer 17 with respect to scale 18 to adjust the sensitivity of the seismically activated switch mechanism within control unit 10. Pointer 17 is movable through approximately one hundred eighty degrees to adjust sensitivity. Thus, for example, with sensitivity adjuster 16 positioned as shown in FIG. 1, control unit 10 is set to medium sensitivity causing control unit 10 to couple power to output 12 in response to moderate seismic activities. Conversely, with adjuster 16 pivoted to move pointer 17 to the clockwise end of scale 18, control unit 10 is set to its lowest sensitivity thereby requiring a maximum seismic activity to cause control unit 10 to couple power from battery 13 to output 12. Of course, intermediate positions of sensitivity adjuster 16 provide correspondingly intermediate sensitivity settings for control unit 10. It will be apparent to those skilled in the art that the apparatus shown in FIG. 1 provides a simple, easily operated and easily used seismically activated appliance control which, despite its simplicity of operation, provides easy adjustment and control of the seismic switch within the control unit.

FIG. 2 sets forth a section view of control unit 10 taken along section line 2—2 in FIG. 1. As described above, housing 11 supports a sensitivity adjuster 16 having a pointer 17 together with a switch 14 having a toggle 15 upon the upper surface of the housing. As is also described above, housing 11 defines aperture 25 which receive battery 13 and power output 12. Housing 11 further defines a pair of support grooves 36 and 37 which in turn receive and support a generally planar plate 33 within the interior of housing 11. Plate 33 defines an aperture 34 within which a guide 39 is rotatably supported. Plate 33 further includes a raised boss 47 defining a threaded aperture 45 therethrough.

Housing 11 further includes a second pair of support grooves 42 and 43 which receive and support a generally planar plate 40 beneath plate 33. Plate 40 defines an aperture 41 at one side and an aperture 38 near the center thereof. An elongated shaft 31 extends downwardly from sensitivity adjuster 16 through aperture 30 formed in housing 11 and guide 39 within aperture 34 of plate 33. Shaft 31 terminates at its lower end in a base 35 which is received within aperture 38 of plate 40. A large diameter gear 32 is secured to the lower end of shaft 31 and is rotatable therewith.

A threaded shaft 46 is received within aperture 45 of boss 47 and extends both above and below boss 47. A splined shaft 44 extends downwardly from threaded shaft 46 through aperture 41 of plate 40. Splined shaft 44 defines a plurality of radially spaced splines sized and configured to engage the teeth of gear 32 such that rotation of gear 32 produces a corresponding rotation of splined shaft 44.

A generally U-shaped ring support 50 is secured to the lower end of splined shaft 44 and extends downwardly in an inverted position. An annular ring 51 is secured to and carried by the lower ends of ring support 50. As is better seen in FIGS. 3 and 4, ring 51 is generally annular defining a center aperture 58. In the preferred fabrication of the present invention, ring support 50 and ring 51 are fabricated of a conductive material such as metal or the like. Similarly, in the preferred fabrication of the present invention, splined shaft 44 is formed of a conductive metal or other conductive material and is guided within aperture 41 of plate 40 by a conductive guide or bearing 48. Plate 40 is also fabricated of a conductive material such as metal or the like. As a result, an electrical connection is maintained between ring 51, ring support 50, splined shaft 44, collar 48 and conductive plate 40 at all times.

Housing 11 further includes a support 84 extending inwardly within housing 11 which in turn receives and supports a silicon-controlled rectifier circuit element 85. Silicon-controlled rectifier 85 (SCR) is fabricated entirely in accordance with conventional fabrication techniques and includes an anode 87, a cathode 88 and a gate electrode 86. An insulating base 55 is secured to the bottom surface of housing 11 and receives a generally cylindrical post 56. Post 56 in turn supports a vertically oriented spring rod 53. Rod 53 is fabricated of a spring steel material or the like and extends upwardly beneath ring support 50 and ring 51. In further accordance with the present invention, a contact weight 52 fabricated at least partially of a conductive material such as metal or the like is secured to the upper end of spring rod 53 and passes through aperture 58 of ring 51. In its preferred form, contact weight 52 defines an outer surface 54 having a varying contour or cross-section. For purposes of illustration, surface 54 is shown in FIG. 2 as frusto-conical. However, it will be apparent to those skilled in the art that other tapers or shapes may be utilized in practicing the present invention.

An electrical connector 57 is received upon insulating base 55 and is electrically coupled to post 56. Connector 57 is electrically connected to gate electrode 86 of SCR 85.

Switch 14 is a prepositioned switch having a center contact 80 and side contacts 81 and 82. Center contact 80 is coupled to terminal 21 of battery 13. Connector 81 is coupled to anode 87 of SCR 85 and is further coupled to conductive plate 40 at a connection 83. Connector 82 is coupled to connecting wire 23 of power output 12 and is further coupled to cathode 88 of SCR 85.

In operation, switch 14 is positioned to determine the mode of operation of control unit 10 and the seismic switching device therein. Thus, with toggle 15 positioned in the center position shown in solid-line representation, switch 14 is in the off position and no electrical connection is provided between center connector 80 and connectors 81 or 82. As a result, battery 13 is not coupled to power output 12 and the controlled appliance (not shown) coupled to output 12 remains off. This off condition persists despite seismic activity. Conversely, in the event toggle 15 is moved to the position indicated by dashed-line representation 15A, electrical connection is provided between connectors 80 and 82 of switch 14. As a result, terminal 21 of battery 13 is connected directly to connecting wire 23 of power output 12. Since connecting wire 20 and terminal 22 are directly coupled, the power coupling between battery 13 and output 12 is completed by switch 14 and the controlled appliance (not shown) is continuously activated during either the presence or absence of seismic activity.

Control unit 10 is configured for seismic activation of the controlled appliance by moving toggle 15 of switch 14 to dashed-line position 15B. In this position, connector 80 of switch 14 and connector 81 are electrically coupled which in turn couples terminal 21 of battery 13 directly to conductive plate 40 and anode 87 of SCR 85. With switch 14 thus set to position 15B, SCR 85 has anode 87 coupled to plate 40 and to power input terminal 21. Cathode 88 of SCR 85 is coupled to connecting wire 23 of power output 12. Thus, the anode to cathode conducting path of SCR 85 is coupled between connecting wires 21 and 23 of battery 13 and power output 12 respectively. In accordance with the well known characteristics of silicon-controlled rectifiers, the anode to cathode conduction of SCR 85 remains open in the absence of a suitable voltage applied to gate electrode 86. In accordance with the present invention, gate electrode 86 is coupled to connector 57 which in turn is connected to post 56, spring rod 53 and contact weight 52. Similarly, conductive ring 51 is electrically connected to conductive plate 40 by ring support 50, spline shaft 44 and collar 48. Conductive plate 40 is in turn coupled to anode 87 of SCR 85. As a result, the combination of contact weight 52 and conductive ring 51 provide a switch coupling between gate electrode 86 and anode 87 of SCR 85. Under normal circumstances, spring rod 53 supports contact weight 52 within aperture 58 of ring 51 and no electrical connection is made between contact weight 52 and ring 51. In the event of seismic activity, however, the spring characteristic of rod 53 allows contact weight 52 to move within aperture 58 of ring 51 in the manner indicated by arrows 59. The movement of contact weight 52 and spring rod 53 is an oscillatory motion due to the spring characteristic of rod 53. The extent of oscillatory motion of contact weight 52 is determined by the magnitude of movement which the seismic activity imparts to housing 11. Once contact weight 52 moves a sufficient distance within ring 51 to bring contact weight 52 into contact with the interior edge of ring 51, an electrical circuit is completed between gate electrode 86 and anode 87 of SCR 85 due to the above-described coupling. In accordance with the well known operation of silicon-controlled rectifiers, SCR 85 is triggered by a brief application of voltage to gate electrode 86 to initiate conduction between anode 87 and cathode 88. Once this momentary application of gate voltage has occurred, the conduction of SCR 85 continues despite the removal of gate voltage. Thus, the momentary connection between contact 52 and ring 51 is sufficient to trigger the conduction of SCR 85. As SCR 85 conducts, a coupling path is provided between terminal 21 of battery 13 and connecting wire 23 of power output 12. This power coupling is maintained until switch 14 is returned to the off position to interrupt the conduction of SCR 85 or the load is removed.

In accordance with an important aspect of the present invention, contact weight 52 defines a tapered or noncylindrical surface 54. Thus, the distance which contact weight 52 must move in order to contact the interior edge of ring 51 is determined primarily by the cross-sectional dimension of contact weight 52 within the plane of ring 51. Thus, as is set forth below in FIGS. 3 and 4 in greater detail, vertically positioning ring 51 at the lower end of contact weight 52 places a smaller cross-sectional dimension of weight 52 within the plane of ring 51 and presents the situation shown in FIG. 4. As can be seen with temporary reference to FIG. 4, this positioning of ring 51 increases the deflection of spring rod 53 and movement distance of contact weight 52 necessary to provide electrical contact between weight 52 and ring 51. Conversely, in the event ring 51 is positioned toward the top portion of weight 52, a substantially greater cross-section dimension of contact weight 52 is placed within the plane of ring 51 which reduces the deflection of rod 53 and movement distance of contact weight 52 required to create electrical connection between weight 52 and ring 51. As a result, the seismic energy or movement of housing 11 required to cause electrical contact between weight 52 and ring 51 is determined substantially by the spring constant of rod 53 and the vertical position of ring 51 with respect to contact weight 52. This, of course, relates directly to the operational sensitivity of control unit 10 in that a seismic energy threshold is established by vertically positioning ring 51.

In accordance with an important aspect of the present invention, this adjustment of sensitivity through vertical positioning of ring 51 is accomplished by a novel highly reliable and effective mechanism which includes shaft 31, gear 32, threaded shaft 46, spline shaft 44 and ring support 50. More specifically, pivotal motion of sensitivity adjuster 16 and pointer 17 in the direction indicated by arrow 65 (counterclockwise when viewed from above) causing a corresponding counterclockwise rotation of gear 32. The engagement of gear 32 with splined shaft 44 causes gear 32 to rotate spline shaft 44 and threaded shaft 46 in the clockwise direction (viewed from above) indicated by arrow 66. As threaded shaft 46 is rotated in the clockwise direction, the cooperation of threaded aperture 45 and threaded shaft 46 causes shaft 46 to move downwardly in the direction indicated by arrow 67. Correspondingly, spline shaft 44 and ring support 50 are also forced downwardly by the action of threaded shaft 46 within threaded aperture 45. As a result, ring 51 is moved downwardly with respect to contact weight 52 in the direction indicated by arrow 68. This adjustment of adjuster 16 decreases the sensitivity of control unit 10 and, as a result, a greater seismic energy is required to cause power to be coupled to power output 12 and the controlled appliance (not shown). Conversely, rotation of adjuster 16 in the direction indicated by arrow 60 (clockwise when viewed from above) causes a corresponding clockwise rotation of gear 32 which in turn produces counterclockwise rotation of spline shaft 44 in the direction indicated by arrow 61. In response to this counterclockwise rotation, threaded shaft 46 is driven upwardly within threaded aperture 45 in the direction indicated by arrow 62. As threaded shaft 46 and spline shaft 44 are raised, ring Support 50 is also raised upwardly in the direction indicated by arrow 63 moving ring 51 toward the larger dimension and of contact weight 52. With this adjustment, the greater dimension of contact weight 52 within the plane of ring 51 reduces the distance which weight 52 must travel to contact ring 51 thereby increasing the sensitivity of control unit 10. With increased sensitivity, control unit 10 responds to seismic energy at lower levels.

FIG. 3 sets forth a section view of a portion of control unit 10 taken through section lines 3—3 in FIG. 2. As described above, ring support 50 supports an annular ring 51 defining an interior aperture 58. As is also described above, contact weight 52 is resiliently supported within aperture 58. As can be seen, FIG. 3 corresponds generally to the position of ring 51 and ring support 50 shown in FIG. 2. As a result, the cross-sectional dimension of contact weight 52 within the plane of ring 51 establishes a distance 69 which contact weight 52 must move to provide triggering of SCR 85 (shown in FIG. 2).

FIG. 4 sets forth the section view of FIG. 3 depicting the configuration resulting from pivoting adjuster 16 (seen in FIG. 2) so as to move ring 51 downwardly toward the dashed-line position shown in FIG. 2. As a result, ring support 50 supports ring 51 such that the plane of ring 51 is aligned with a substantially smaller cross-sectional dimension of contact weight 52. As a result, a substantially greater distance indicated by arrow 79 must be traversed by weight 52 to contact the interior edge of aperture 58 of ring 51. This adjustment of the vertical position of ring 51 substantially reduces the sensitivity of control unit 10 requiring substantially greater seismic energies to initiate conduction of SCR 85 (seen in FIG. 2).

In accordance with an important advantage of the embodiment of the present invention shown in FIGS. 2 and 3, gear 32 is substantially greater than spline shaft 44 providing several rotations of spline shaft 44 in response to relatively small angular movements of gear 32. This facilitates a finer adjustment of the sensitivity of control unit 10 allowing the user to move ring 51 vertically with relatively small angular pivotal movements of adjuster 16.

FIG. 5 sets forth an exemplary scale 18 which provides a convenient indication of sensitivity when utilized in combination with pointer 17 on the top of housing 11 (seen in FIG. 1). Scale 18 provides a plurality of sensitivity indicators 70 through 73 which are shown together with approximate seismic energy indications corresponding to Richter scale numbers. To provide visual indication, indicators 70 through 73 are represented by progressively greater diameter circles indicative of greater seismic energy or Richter scale values.

Figure 6:
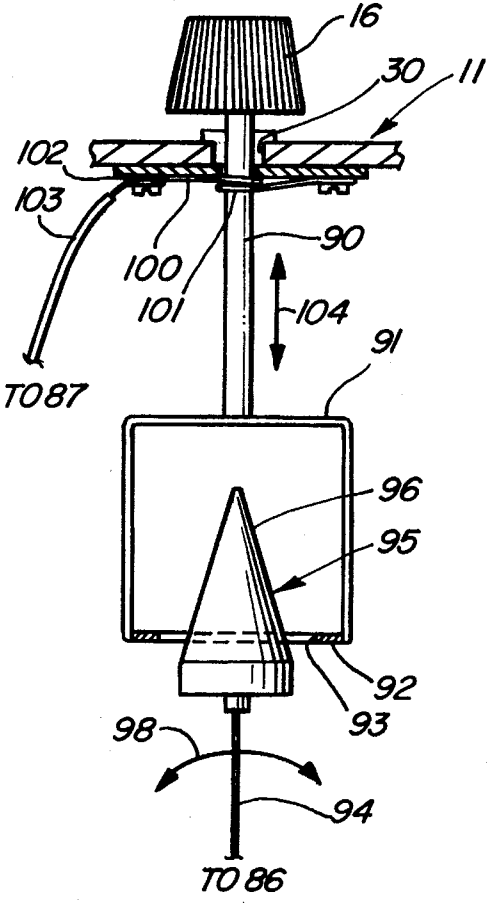
FIG. 6 sets forth a partial section view of an alternate embodiment of the present invention seismically activated appliance switch utilizing an alternative sensitivity adjustment mechanism.

FIG. 6 sets forth a partial section view of an alternate embodiment of the present invention which utilizes a more simplified sensitivity adjusting mechanism. It should be noted that the alternate embodiment of FIG. 6 provides an adjusting mechanism which directly replaces shaft 31, gear 32, threaded shaft 46, spline shaft 44, ring support 50, ring 51, contact weight 52, and spring rod 53 in the embodiment shown in FIG. 2. Thus, in the alternate embodiment of FIG. 6, housing 11 defines an aperture 30 through which a shaft 90 extends. The upper end of shaft 90 supports a sensitivity adjuster 16 while the lower end is coupled to a generally U-shaped inverted ring support 91. The end portions of ring support 91 are secured to an annular ring 92 defining an interior aperture 93. A retainer 100 preferably formed of spring steel or the like is secured to the underside of housing 11 and defines a spring loop 101 which encircles shaft 90 in a pinching encirclement. Thus, spring loop 101 tightly engages shaft 90 retaining the position of shaft 90 in the absence of a downward or upward force upon sensitivity adjuster 16. Retainer 100 further includes a contact 102 coupled to a connecting wire 103 which in turn is connected to anode 87 of SCR 85 (seen in FIG. 2).

A spring rod 94 is vertically supported within housing 11 in the manner set forth above in FIG. 2 for spring rod 53. Spring rod 94 further supports a contact weight 95 defining a conical surface 96. Spring rod 94 is flexible allowing contact weight 95 to flex spring rod 94 in all directions as shown for example by arrows 98.

In operation, the vertical position of ring 92 with respect to contact weight 95 is established by vertical movement of sensitivity adjuster 16 overcoming the gripping force of spring loop 101. Thus, by sliding shaft 90 within spring loop 101 either up or down in the directions indicated by arrows 104, the relative position of ring 92 with respect to contact weight 95 is established. In the position shown in FIG. 6, the plane of ring 92 is aligned with lower portion of conical surface 96 of contact weight 95. In this configuration, the sensitivity of the resulting seismically activated appliance switch is more sensitive. If ring 92 is raised, the conical profile of surface 96 produces a reduced sensitivity in accordance with the principles of adjustment set forth below in FIGS. 2 through 3 for control unit 10. It should be noted, however, that conical surface 96 is the reverse of surface 54 of contact weight 52 shown in FIG. 2. As a result, an inverse relationship between sensitivity and the vertical position of ring 92 is established. Accordingly, a maximum sensitivity is achieved with ring 92 positioned low on contact weight 95 and a minimum sensitivity is established with ring 92 positioned at its highest point with respect to contact weight 95.

Figure 7:
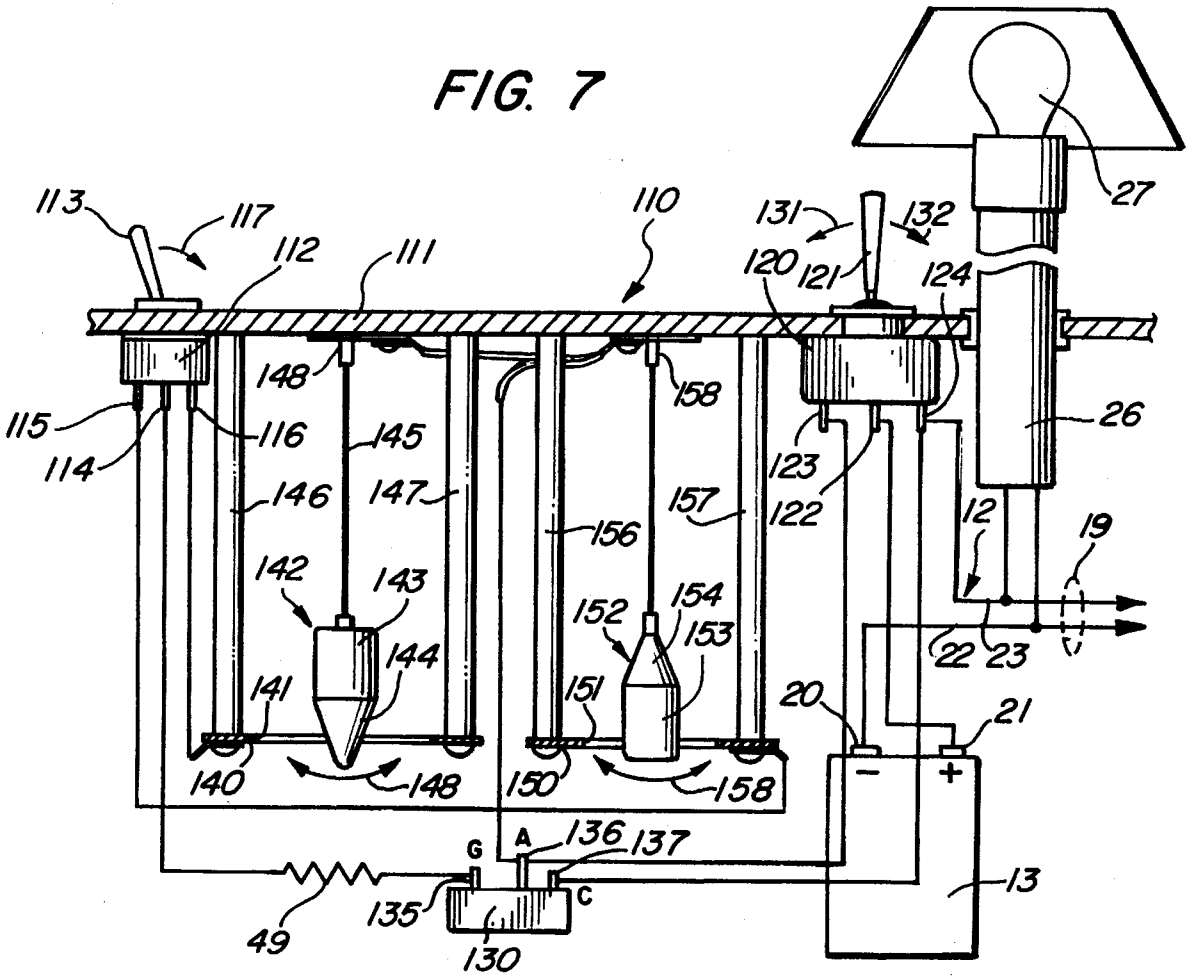
FIG. 7 sets forth a partial section view of a still further alternate embodiment of the present invention seismically activated appliance switch.

FIG. 7 sets forth a partial section view of a still further alternate embodiment of the present invention seismically activated appliance switch generally referenced by numeral 110. By way of overview, control unit 110 utilizes a pair of contact weight and ring switch members to provide additional flexibility in selecting the seismic response for sensitivity of the controlled unit. Each seismically responsive switch apparatus, however, operates in general accordance with the above-described embodiments with the difference in characteristics being provided by the shape of the contact weights and the inside diameters of the two rings.

More specifically, control unit 110 includes a housing 111 supporting a selector switch 112 and a mode switch 120. Switch 112 is preferably formed of a conventional two-position switch having a toggle 113, a center contact 114 and position contacts 115 and 116. Toggle 113 is movable from the position shown in which contact 114 is coupled to contact 116 by pivotal motion in the direction indicated by arrow 117 to couple contact 114 alternatively to contact 115. Switch 120 preferably comprises a conventional three-position switch having a toggle 121 shown in its center off position, a center contact 122 and position contacts 123 and 124. Toggle 121 is shown in the center off position in which center contact 122 is not connected to either of contacts 123 or 124. With toggle 121 pivoted in the direction indicated by arrow 132, contact 122 is coupled to contact 123. Conversely, with toggle 121 pivoted in the direction indicated by arrow 131, contact 122 is coupled to contact 124. A battery 13 includes a terminal 21 coupled to contact 122 and a connecting wire 20. A power output 12 includes a connecting wire 22 coupled to terminal 20 and a connecting wire 23 coupled to contact 124. A silicon-controlled rectifier 130 (SCR 130) is constructed in accordance with conventional fabrication techniques and includes a gate electrode 135 coupled to contact 114 of switch 112, an anode 136 coupled to contact 123 of switch 120, and a cathode 137 coupled to contact 124 of switch 120.

Control unit 110 further includes a pair of downwardly extending insulating supports 146 and 147 which support an annular ring 140. Ring 140 is electrically coupled to contact 116 of switch 112. A spring rod 145 preferably formed of a spring steel material or the like is supported on the underside of housing 111 by a base 148. The lower end of spring rod 145 supports a contact weight 142 having a cylindrical surface 143 and a conical surface 144. The latter extends into the plane of ring 140 through aperture 141.

Control unit 110 further includes a second pair of downwardly extending insulative supports 156 and 157 supporting an annular ring 150 defining an aperture 151 therein. Ring 150 is coupled to contact 115 of switch 112. A base 158 is secured to the undersurface of housing 111 and supports a downwardly extending flexible spring rod 155. Rod 155 is preferably formed of a spring steel material and supports a contact weight 152 having a conical surface 154 and a cylindrical surface 153. Cylindrical surface 153 of contact weight 152 extends downwardly through aperture 151 of ring 150. Bases 148 and 158 are commonly coupled to anode 136 of SCR 130.

Housing 111 further supports a lampstand 26 which extends through an aperture in housing 111. Lampstand 26 further supports an electric bulb 27. Bulb 27 is coupled by conventional connecting means (not shown) to control unit 110 by output power connector 12 having connecting wires 22 and 23. Thus, control unit 110 and lampstand 26 are integrally assembled to provide a seismically activated battery-powered light source. In addition, power output 12 is further coupled to an auxiliary power output 19. The auxiliary power output allows coupling an additional device to the control unit.

In operation, switch 112 is operative to select either the seismic switch provided by contact weight 142 and ring 140 or, alternatively, the seismic switch provided by contact weight 152 and ring 150. In the position shown in FIG. 7, switch 112 provides coupling between contacts 114 and 116 which in turn places the seismic switch formed by contact weight 142 and ring 140 within the operative circuit. Toggle 113 may be pivoted in the direction indicated by arrow 117 to alternatively select the seismic switch provided by contact weight 152 and ring 150.

In accordance with an important advantage of the embodiment shown in FIG. 7, rings 140 and 150 define substantially different apertures 141 and 151. This provides substantially different sensitivity for control unit 110. Thus, by selecting either seismic switch within control unit 110, the unit may be set to respond to either large magnitude activity or small magnitude activity.

With selection of either of the alternative seismic switches provided in the embodiment of FIG. 7, SCR 130 and switch 120 operate in substantially the same manner set forth above for SCR 85 and switch 14 in the embodiment of FIG. 2. Thus, switch 120 may configure control unit 10 in the off position shown with toggle 121 centered or, alternatively, provide uninterrupted power coupling between battery 13 and output 12 to the controlled appliance (not shown) by pivoting toggle 121 in the direction indicated by arrow 131. In both the center position shown and in the pivotal position of toggle 121 in the direction indicated by arrow 131, the powered appliance is insensitive to seismic activity. If, however, toggle 121 is pivoted in the direction indicated by arrow 132, the operation of the controlled appliance is determined by SCR 130 and the selected seismically responsive switch. Thus, with toggle 121 pivoted in the direction indicated by arrow 132 and with toggle 113 of switch 112 pivoted to the position shown, seismic activity sufficient to flex spring rod 145 and move contact weight 142 against ring 140 by flexing in the manner shown by arrows 148 is required to couple a gate voltage to gate electrode 135 and fire SCR 130. When SCR 130 fires, electrical power is coupled from battery 13 to power output 12. Conversely, if toggle 113 is pivoted in the direction indicated by arrow 117 placing the alternative seismically activated switch mechanism within the operative circuit of control unit 110, a seismic activity sufficient to flex spring rod 155 moving contact weight 152 in the manner indicated by arrows 158 is required to provide the gate voltage for SCR 130 in order to fire SCR 130 and provide power coupling between battery 13 and output 12.

It will be apparent to those skilled in the art that the embodiment of FIG. 7 utilizing alternative seismic switch characteristics represents still further flexibility in the operation of the present invention system. It will be equally apparent to those skilled in the art that while contact weights 142 and 152 are shown for purposes of illustration, weights of different shapes or profiles may be utilized without departing from the spirit and scope of the present invention. Thus, the embodiment of FIG. 7 provides an alternative to the position adjusting apparatus used to control sensitivity and operational characteristic of the present invention seismically activated appliance switch.

Figure 8:
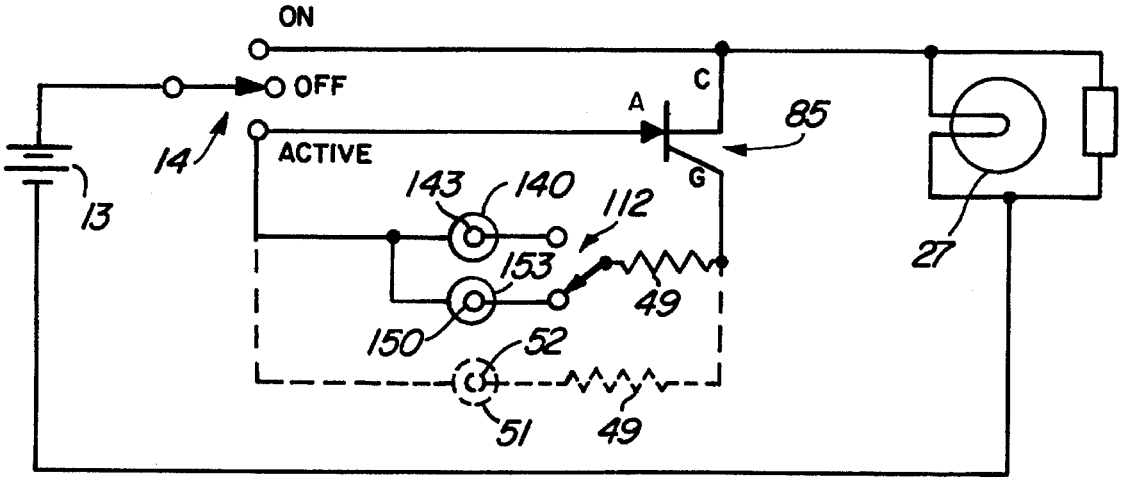
FIG. 8 sets forth a schematic diagram of the present invention seismically activated appliance switch.

FIG. 8 sets forth a schematic diagram of the electrical circuit for the present invention seismically activated appliance switch. For purposes of convenience, the electrical circuit for the embodiment of FIG. 7 is shown in solid-line representation. In addition, FIG. 8 also shows the alternative elements of the system shown in FIGS. 2 and 6 in dashed-line representation. As described above, the present invention control unit includes a battery 13, a switch 14 and an SCR 85. A load 27 is coupled between the on position of switch 14 and battery 13. Switch 14 also includes a system activate position which is coupled to the anode of SCR 85. The gate of SCR 85 is coupled to switch 112 which in turn is connected to contact weights 143 and 153. Contact rings 140 and 150 are commonly coupled to the system activate position of switch 14. To protect the gate of SCR 85, resistors 49 are placed in series with the gate. For example, if battery 13 is six volts, resistor 49 is one hundred twenty five ohm. For greater voltages, larger resistance is used.

In operation, if switch 14 is moved to the on position, battery 13 is directly coupled to load 27. This removes SCR 85 from the circuit and avoids the loss of battery power due to the voltage drop of SCR 85. With switch 14 in the active position, SCR 85 is triggered when the seismic switch elements selected by switch 112 make contact in the manner described above.

In the single contact embodiment shown in FIGS. 2 and 3, the dashed-line elements of contact weight 52 and contact ring 51 replace switch 112, contact rings 140 and 150, and contacts weights 143 and 153.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in controlling an electrically powered device, a seismically activated switch apparatus comprising:

an electronic switch having a controlled power coupling path and a trigger input;

an input power coupler and output power coupler interconnected through said controlled power coupling path;

an annular ring defining a ring plane and an aperture;

a contact weight defining a varying cross-section;

a spring rod having a fixed end and a free end, said free end being secured to said contact weight and said spring rod resiliently supporting said contact weight; and adjustable ring support means for supporting said ring such that said contact weight extends through said aperture of said ring and for raising and lowering said ring to move said ring plane with respect to said contact weight, said trigger input being coupled to said input power coupler through contact of said annular ring and said contact weight.

2. A seismically activated switch apparatus as set forth in claim 1 wherein said adjustable ring support means includes:

an inverted generally U-shaped ring support having an upper portion and downwardly extending ends; and means for vertically moving said ring supports, said annular ring being attached to said ring support at said ends.

3. A seismically activated switch apparatus as set forth in claim 2 wherein said spring rod fixed end is positioned beneath said annular ring and wherein said spring rod extends upwardly from said fixed end to support said contact weight.

4. A seismically activated switch apparatus as set forth in claim 3 wherein said contact weight defines a generally frusto-conical surface.

5. A seismically activated switch apparatus as set forth in claim 4 wherein said contact weight further defines a generally cylindrical surface.

6. A seismically activated switch apparatus as set forth in claim 3 wherein said means for vertically moving said ring support includes:

a first rotatable shaft;

a first gear joined to and rotated by said first rotatable shaft;

an elongated splined shaft, engaging said first gear, having a first end supporting said ring support and a second end defining a threaded shaft; and a threaded support having a threaded aperture receiving said threaded shaft.

7. A seismically activated switch apparatus as set forth in claim 6 wherein said first gear defines a first diameter and wherein said splined shaft defines a second diameter substantially smaller than said first diameter.

8. A seismically activated switch apparatus as set forth in claim 7 wherein said contact weight defines a generally frusto-conical surface.

9. A seismically activated switch apparatus as set forth in claim 8 wherein said contact weight further defines a generally cylindrical surface.

10. A seismically activated switch apparatus as set forth in claim 3 wherein said means for vertically moving said ring support includes:

an elongated shaft having an upper end and a lower end, said lower end being joined to said ring support; and a friction member frictionally engaging said elongated shaft to provide vertically slidable support for said shaft.

11. A seismically activated switch apparatus as set forth in claim 10 wherein said friction member includes a spring having a spring loop encircling said elongated shaft.

12. A seismically activated switch apparatus as set forth in claim 11 wherein said contact weight defines a generally frusto-conical surface.

13. A seismically activated switch apparatus as set forth in claim 12 wherein said contact weight further defines a generally cylindrical surface.

14. For use in controlling an electronically powered device, a seismically activated switch apparatus comprising:

an electronic switch having a controlled power coupling path and a trigger input;

an input power coupler and an output power coupler interconnected through said controlled power coupling path;

a first annular ring defining a first ring plane and a first aperture;

a first contact weight;

a first spring rod having a first fixed end and a first free end, said first free end being secured to said first contact weight and said first spring rod resiliently supporting said first contact weight within said first ring plane and extending partially through said first aperture;

a second annular ring defining a second ring plane and a second aperture;

a second contact weight;

a second spring rod having a second fixed end and a second free end, said second free end being secured to said second contact weight and said second spring rod resiliently supporting said second contact weight within said second ring plane and extending partially through said second aperture; and a first switch alternatively coupling said trigger input to said input power coupler through contact of said first ring with said first contact weight or through contact of said second ring with said second contact weight.

15. A seismically activated switch apparatus as set forth in claim 14 further including a second switch apparatus for directly coupling said power input coupler to said output power coupler.

* * * * *